US006071039A

United States Patent [19]

Ogura et al.

[11] Patent Number: 6,071,039

[45] Date of Patent: Jun. 6, 2000

[54] STRUCTURE OF SURFACE PORTIONS OF GROUNDS

[75] Inventors: Katsuyuki Ogura, Tokyo; Yoshio Aihara, Kanagawa, both of Japan

[73] Assignees: Dyflex Corporation, Tokyo; Ay Chemical Co., Ltd., Kanagawa, both of Japan

[21] Appl. No.: 09/126,169

[22] Filed: Jul. 30, 1998

Related U.S. Application Data

[63] Continuation of application No. PCT/JP97/02878, Aug. 20, 1997.

[30] Foreign Application Priority Data

Jan. 26, 1996 [JP] Japan ..... 8-011713

[51] Int. Cl.[7] ..... E01C 5/18; E01C 13/00

[52] U.S. Cl. ..... 404/32; 404/21; 404/31; 404/36

[58] Field of Search ..... 404/31, 32; 75/434

[56] References Cited

U.S. PATENT DOCUMENTS

| | | | |
|---|---|---|---|
| 4,708,516 | 11/1987 | Miller | 404/31 |
| 5,020,936 | 6/1991 | Malmgren et al. | 404/32 |
| 5,432,213 | 7/1995 | Kim et al. | 524/41 |
| 5,569,314 | 10/1996 | Mikhail et al. | 75/434 |

FOREIGN PATENT DOCUMENTS

| | | |
|---|---|---|
| 7-158007 | 6/1995 | Japan . |
| 8-109603 | 4/1996 | Japan . |

OTHER PUBLICATIONS

Chemical Engineer's Handbook; 4th Edition, John H. Perry, 1976.

*Primary Examiner*—Eileen Dunn Lillis
*Assistant Examiner*—Raymond W. Addie
*Attorney, Agent, or Firm*—Baker & Daniels

[57] ABSTRACT

On a roadbed layer (4) is formed a cushion layer (5) of 50 mm to 200 mm in thickness which is formed by using elastic chips alone or in mixture with sand, each elastic chip being formed of elastic material and having a size of 7 mm to 0.05 mm, preferably 2 mm to 0.5 mm and a specific gravity of 1.8 to 3.5. The cushion layer (5) contains elastic chips of 3 wt % or more. The elastic chips are formed by mixing a material selected from the group consisting of synthetic rubber, natural rubber and synthetic resin with a specific gravity adjusting material of inorganic powder having a specific gravity of 3 or more.

11 Claims, 1 Drawing Sheet

STRUCTURE OF SURFACE PORTIONS OF GROUNDS

CROSS REFERENCE TO RELATED APPLICATION

This is a continuation of International Application PCT/JP97/02878 filed Aug. 20, 1997.

TECHNICAL FIELD

The present invention relates to a structure of surface portions of grounds such as a dirt course for a horse racing track, a volleyball court, a tennis court, a track of athletic sports, a general playground, etc.

BACKGROUND OF THE INVENTION

In a dirt course of a horse racing track, a river sand layer is normally formed on a subgrade layer in consideration of drainage and shock absorption, and the river sand layer is used as a cushion layer of the ground surface. However, such a cushion layer has the following disadvantages. That is, when it is used for a long term, the river sand is pulverized by kicking impacts of horseshoes, and the pulverized river sand is sedimented at the bottom portion of the cushion layer to form a hard plate-shaped layer. Therefore, water permeability is lowered and a drainage trouble occurs. Further, the substantial thickness of the cushion layer is reduced, resulting in occurrence of such an accident that horse legs are damaged when the horse kicks the hard plate-shaped layer with the horseshoes.

Therefore, it has been proposed that chipped rubber (which is mainly composed of wasted tire rubber) or plastic which are adopted in general sport facilities such as tracks for athletic sports, etc. are mixed with river sand to form a cushion layer of the dirt course.

However, such chipped rubber or plastic has a specific gravity of about 1.1 to 1.5, and when it is blended with sand, the chips are floated to the surface of the cushion layer because of the difference of the specific gravity therebetween, so that uniformity of the cushion layer cannot be kept. Further, much consideration has not been paid to the function of preventing pulverization (silting) of sand for its use term.

The present invention has been implemented on the basis of the above situation, and has an object to promote uniformity and stability of a cushion layer in the structure of the ground surface portion and also suppress pulverization of the cushion layer.

Further, the present invention has another object to provide the structure of the ground surface portion which can promote athletes or other ground players to have excellent motions (that is, which can give excellent driving force for walking or running: so-called good "kickback").

SUMMARY OF THE INVENTION

In order to attain the above objects, a cushion layer which is obtained by arranging elastic chips alone or blending elastic chips and sand with each other is formed on a groundwork, each elastic chip having a size of 7 mm to 0.05 mm, preferably 2 mm to 0.5 mm and a specific gravity of 1.8 to 3.5, and being formed of elastic material.

The elastic material may be prepared by blending a material selected from the group consisting of synthetic rubber, natural rubber and synthetic resin with a specific gravity adjusting material of inorganic powder having a specific gravity of 3 or more.

The cushion layer preferably contains elastic chips of 3% or more by weight. By using the elastic chips having the specific gravity near that of sand alone or using the elastic chips while mixed with sand at a suitable mixing rate, the uniformity and stability of the cushion layer (including uniformity and stability with time lapse) can be achieved, and pulverization of the cushion layer can be suppressed.

The thickness of the cushion layer can be set to any suitable value in accordance with an application purpose. For example, when it is applied to a dirt course of a horse race track, it is preferably set to 50 mm to 200 mm. If the thickness is less than 50 mm, it would be frequently difficult to obtain an excellent cushion performance for racing horses. On the other hand, if the thickness is more than 200 mm, cost efficiency is apt to be lowered.

The cushion layer may be formed on a roadbed layer which is formed at a thickness of 200 mm to 300 mm by tamping sand or soil or at a thickness of 50 mm to 70 mm by execution of asphalt concrete pavement or concrete pavement.

PREFERRED EMBODIMENT FOR CARRYING OUT THE INVENTION

Figure 1:
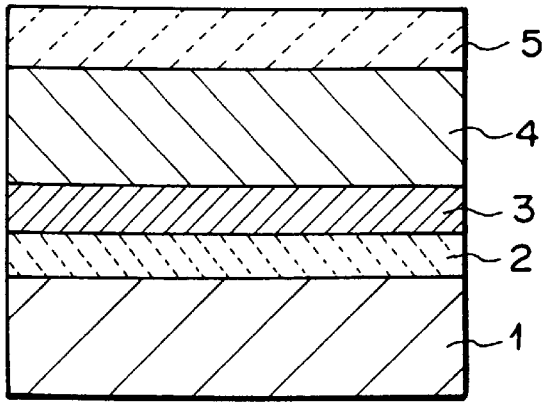
FIG. 1 is a schematic cross-sectional view showing an embodiment of the present invention.

In the present invention, as shown in FIG. 1, a dirt course of a horse racing track includes an unscreened crushed stone layer 1 formed at a thickness of 250 mm, a volcanic gravel layer 2 which is formed at a thickness of 50 mm on the unscreened crushed stone layer 1, a cinder layer 3 which is formed at a thickness of 50 mm on the volcanic gravel layer 2, a roadbed layer 4 which is formed at a desired thickness (preferably from 200 mm to 300 mm) on the cinder layer 3 by tamping pit sand (particle size: 2 mm to 0.5 mm) or the like, and a cushion layer 5 which is formed at a desired thickness (preferably, 50 mm to 200 mm), the cushion layer 5 being formed of elastic chips each of which is formed of elastic material and has a size of 7 mm (3 meshes) to 0.05 mm (300meshes), preferably 2 mm (10 meshes) to 0.5 mm (40 meshes) and a specific gravity of 1.8 to 3.5. The size of the elastic chip is determined so that if a chip can pass through a sieve having a coarser mesh size defining the above range, but cannot pass through a sieve having a finer mesh size defining the above range, the chip is judged to have the size within the above range. In the present invention, it is most preferable that the sizes of all the elastic chips contained in the cushion layer are within the above range, however, a small amount of elastic chips whose sizes are out of the above range (for example, within 10% by weight of all the elastic chips, preferably within 5% by weight, more preferably within 2% by weight, much more preferably within 1% by weight) may be contained.

A mixture of the above elastic chips and sand, preferably a mixture of the above elastic chips and river sand (particle size: 2 mm to 0.5 mm) may be used as the cushion layer 5. In this case, it is preferable that the amount of the elastic chips is set to 3% or more by weight of the amount of sand. The effectiveness of the elastic chips will be described in detail in the following example.

The elastic chips are designed in a flake-shape or a particular shape, however, the shape of each chip is not limited to these shapes. The size of the elastic chips is preferably set to about 2 mm to 0.5 mm which is near to the size of particles (grain size) of pit sand or river sand.

The elastic material is formed by mixing a material selected from the group consisting of synthetic rubber such as ethylene-propylene rubber, urethane rubber or the like, natural rubber or general-purpose synthetic resin such as vinyl chloride resin, vinyl acetate resin, polystyrene, polyethylene, polypropylene or the like with a specific gravity adjusting material such as an inorganic powder material (preferably, 3 or more in specific gravity) such as titanium oxide, barium sulfate, barium carbonate, lithopone, iron oxide, lead oxide, antimony oxide, zinc oxide or the like.

The elastic chips may be formed of material having a specific gravity of 2.5 obtained by mixing EPDM (ethylene propylene rubber) of 100 parts by weight with barium sulfate of 400 parts by weight.

EXAMPLES

The elastic chips were formed of material having a specific gravity of 2.5 obtained by mixing EPDM of 100 parts by weight with barium sulfate of 400 parts by weight. The particle size of the elastic chips was set to 2 mm to 0.5 mm, and a pulverization test of the cushion layer 5 was carried out.

As samples of the cushion layer were used a sample 1 (river sand (particle size of 2 mm to 0.5 mm: this was applied to the following samples) was blended with the above elastic chips of 3 wt % (97:3)), a sample 2 (river sand was blended with the above elastic chips of 10 wt % (9:1)), a sample 3 (river sand was blended with the above elastic chips of 20 wt % (8:2)), and a comparative example (prior art example) (river sand of 100 %).

A method for the pulverization test was as follows. Each sample was put at a thickness of 70 mm (weight: about 1450 g) in a vessel of 150 mm diameter, and an iron rod of 50 mm in diameter and 4.5 kg in weight was gravity-dropped on the sample from a height of 425 mm. This dropping operation was carried out at 1000 times, and then fine powder was separated by a sieve of No. 100 mesh to measure the amount of the fine powder thus separated.

The pulverization test result is shown in the following Table 1.

TABLE 1

| Sample No. | 1 | 2 | 3 | comp.example |
|---|---|---|---|---|
| Amount of fine powder | 160 g | 103 g | 90 g | 207 g |

It is concluded that as compared with the comparative example using 100% sand, the pulverization degree was reduced to the half when the elastic chips of 10% or more by weight were blended into river sand. That is, it is understood that the elastic chips absorb impact energy and remarkably reduce breakage of sand.

Figure 3:
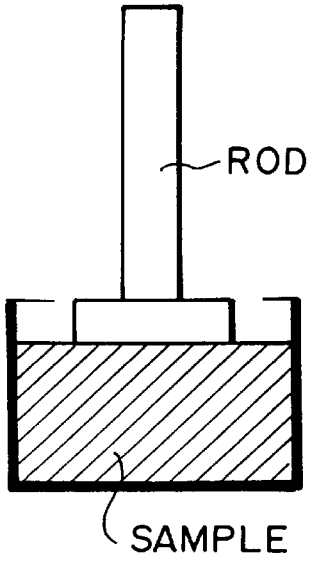
FIG. 3 is a schematic diagram showing an apparatus used for a test to obtain the test result shown in FIG. 2.
Figure 2:
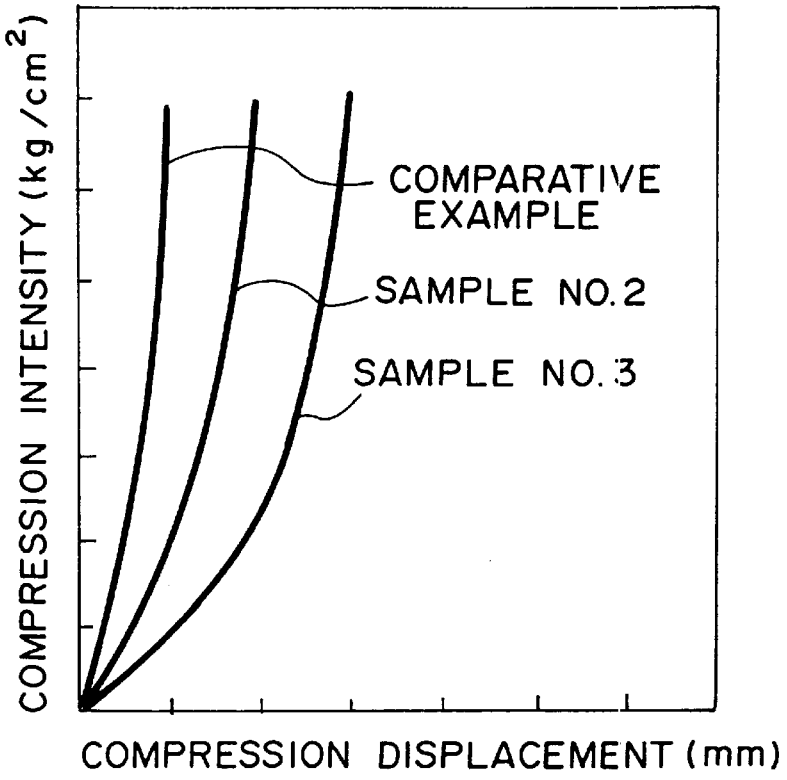
FIG. 2 is a graph showing a test result relating to the present invention.

Further, in an impact energy relaxation test of the cushion layer, the result shown in FIG. 2 was obtained. According to this test, as shown in FIG. 3, each of the above samples was put at a thickness of 40 mm in a vessel, and it was compressed at a rate of 5 mm/minute by a compression tester "STROGRAPH" [manufactured by TOYOSEIKI CO., LTD.] using a rod having a contact surface of 40 mm×40 mm. It is apparent from the graph of FIG. 2 that the samples 2 and 3 more greatly increase the compression displacement as compared with the comparative example, and exhibit high cushion performance.

This structure of the ground surface having high cushion performance as described above is particularly effective when it is applied to a dirt course of a horse race track. The effect of use of the elastic chips resides in that the motional performance thereon is excellent (that is, occurrence of getaway [flow] of the elastic chips and the sand when they are treaded is little, and the driving force of walking or running can be effectively obtained, so that so-called "kick-back" becomes good. This effect is more remarkable when synthetic rubber or natural rubber is used as the material of the elastic chips, or when synthetic resin having higher rubber elasticity is used.

Further, a time-lapse stability comparison test for uniformity of mixed material of the cushion layer was visually carried out on the cushion layer containing 20% elastic chips of the sample 3 and the cushion layer containing tire rubber chips (specific weight: 1.1 to 1.5 and mixed by 20 wt %) as the elastic chips. The following result was obtained through the visual comparison test. That is, both the cushion layers were respectively laid at a thickness of 50 mm on a bustling road and left for two months. According to the visual test, it was apparent that the former cushion layer according to the present invention had no variation on the surface, whereas in the latter cushion layer, a large amount of the mixed material (tire rubber chips) were isolated from river sand and floated onto the surface, so that the stability of the cushion layer of the latter was reduced. This makes it significant to adjust the specific gravity of the elastic chips.

In the above embodiment, the structure of the surface portion of the ground of the present invention is applied to the dirt course of the horse race track, however, it is needless to say that the structure of the ground surface portion of the present invention is applied to other sport facilities such as tennis courts, volleyball courts, other ball game grounds, athletic grounds, multi-purpose places, campus, schoolyards, etc.

In these cases, soil may be used for the roadbed in addition to sand in accordance with an application purpose, and it may be formed at a thickness of 50 mm to 70 mm by paving with asphalt concrete or concrete.

As described above, according to the present invention, the elastic chips formed of elastic material, each of which has a size of about 7 mm to 0.05 mm, preferably 2 mm to 0.5 mm and a specific gravity of 1.8 to 3.5, are laid, preferably at a thickness of 50 mm to 200 mm, alone or in mixture with sand to thereby form a cushion layer, whereby the time-lapse stability of the cushion layer of the ground surface portion which is repetitively treaded can be enhanced to suppress the pulverization of the cushion layer. Further, use of the elastic chips can provide the driving force of walking or running effectively, and thus the motion (physical exercise) can be made excellent.

Industrial Utility

As described above, the structure of the ground surface portion of the present invention can be applied to dirt courses of horse race tracks, other sport facilities such as tennis courts, volleyball courts, other ball game grounds, athletic grounds, multi-purpose places, campus, schoolyards, etc.

What is claimed is:

1. A structure of a ground surface portion, characterized by including a cushion layer which is obtained by arranging elastic chips alone or mixing said elastic chips with sand is formed on a groundwork, said elastic chips comprising an elastic component and a specific gravity adjusting component, said specific gravity adjusting component having a specific gravity of 3 or more, said elastic chips having a size of 7 mm to 0.05 mm and a specific gravity of 1.8 to 3.5.

2. The structure of the ground surface portion as claimed in claim 1, wherein the size of said elastic chips is from 2 mm to 0.5 mm.

3. The structure of the ground surface portion as claimed in claim 1, wherein said elastic component is selected from the group consisting of synthetic rubber, natural rubber and synthetic resin.

4. The structure of the ground surface portion as claimed in claim 3, wherein said specific gravity adjusting material comprises inorganic powder.

5. The structure of the ground surface portion as claimed in claim 1, wherein said cushion layer contains said elastic chips of 3 wt % or more.

6. The structure of the ground surface portion as claimed in claim 1, wherein said cushion layer has a thickness of 50 mm to 200 mm.

7. The structure of the ground surface portion as claimed in claim 1, wherein said groundwork has a roadbed layer which is formed by tamping sand or soil or paving with asphalt concrete or concrete, and said cushion layer is formed on said roadbed layer.

8. The structure of the ground surface portion as claimed in claim 7, wherein the thickness of said roadbed layer formed by tamping sand or soil is set to 200 mm to 300 mm.

9. The structure of the ground surface portion as claimed in claim 7, wherein the thickness of said roadbed layer formed by paving with asphalt concrete or concrete is set to 50 mm to 70 mm.

10. The structure of the ground surface portion as claimed in claim 1, wherein the particle size of said sand is 2 mm to 0.5 mm.

11. The structure of the ground surface portion as claimed in claim 1, wherein said cushion layer contains at least 10% by weight of said elastic chips.

* * * * *